US010820108B2

(12) United States Patent
Zhang et al.

(10) Patent No.: US 10,820,108 B2
(45) Date of Patent: Oct. 27, 2020

(54) SPEAKER

(71) Applicant: AAC Technologies Pte. Ltd., Singapore (SG)

(72) Inventors: Guqing Zhang, Shenzhen (CN); Ronglin Linghu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/528,653

(22) Filed: Aug. 1, 2019

(65) Prior Publication Data

US 2020/0045449 A1 Feb. 6, 2020

(30) Foreign Application Priority Data

Aug. 5, 2018 (CN) ..... 2018 2 1254949 U

(51) Int. Cl.

| | |
|---|---|
| ***H04R 9/04*** | (2006.01) |
| ***H04R 9/06*** | (2006.01) |
| ***H01F 7/08*** | (2006.01) |
| ***H01R 13/24*** | (2006.01) |
| ***H04R 9/02*** | (2006.01) |
| ***H04R 31/00*** | (2006.01) |

(52) U.S. Cl.

CPC ..... *H04R 9/045* (2013.01); *H01F 7/081* (2013.01); *H01R 13/2457* (2013.01); *H04R 9/025* (2013.01); *H04R 9/06* (2013.01); *H04R 31/006* (2013.01); *H04R 2400/11* (2013.01)

(58) Field of Classification Search

CPC ..... H04R 9/06; H04R 9/025; H04R 31/006; H04R 2400/11; H04R 9/045; H01F 7/081; H01R 13/2457

USPC ..... 381/332

See application file for complete search history.

(56) References Cited

U.S. PATENT DOCUMENTS 10,250,993 B1 * 4/2019 Xiao ..... H04R 9/06

* cited by examiner

*Primary Examiner* — Paul Kim

(74) *Attorney, Agent, or Firm* — W&G Law Group LLP

(57) ABSTRACT

A speaker is provided. The speaker includes: an electrical connector and a voice coil. The electrical connector includes an elastic arm and a connection portion. The voice coil includes an outer side surface close to the elastic arm and an inner side surface opposite to the outer side surface, each of the joint portions includes a body portion supported at a side of the voice coil facing away from the diaphragm, a first extension portion formed by extending from the body portion and being opposite to the inner side surface, and a second extension portion formed by extending from the body portion and being opposite to the outer side surface, the first extension portion and the second extension portion are spaced apart to form a receiving groove, and the voice coil is sandwiched and fixed in the receiving groove.

8 Claims, 6 Drawing Sheets

A–A

SPEAKER

TECHNICAL FIELD

The present disclosure relates to the field of electric-acoustic conversion technologies, and in particular to, a speaker.

BACKGROUND

With the rapid development of technologies, audio devices become more and more popular. People's requirements for audio devices are not limited to playback of video and audio, and they also require for reliability of audio devices. Especially in the 3G era, mobile multimedia technology has also developed. Many audio devices have various entertainment functions, such as video playback, digital camera, games, GPS navigation, etc., all of which require electronic components in audio devices to become more and more sophisticated and compact.

In audio devices, a speaker is a commonly used electronic component, mainly used for the playback of audio signals. In the related art, the magnetic flux density in a voice coil inside the speaker is not balanced, resulting in swing or disconnection caused by the unbalanced force applied on the voice coil. Meanwhile, swing of the voice coil may cause problems such as touching the magnet and the unbalanced amplitude.

Therefore, it is necessary to provide a new type of speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
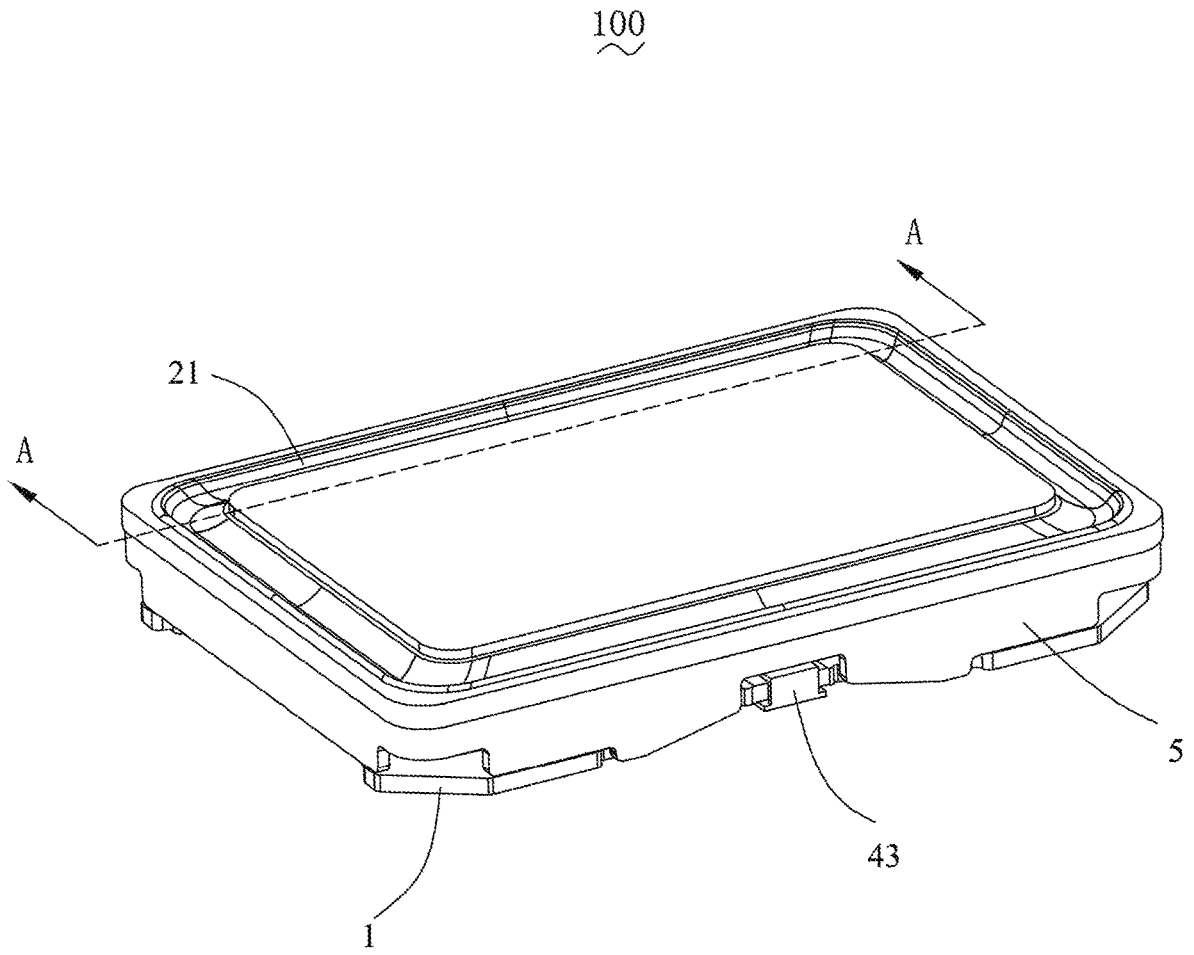
FIG. 1 is a perspective structural diagram of a speaker according to an embodiment of the present disclosure.

The present disclosure will be further illustrated with reference to the accompanying drawings and the embodiments.

Referring to FIGS. 1-4, a speaker 100 provided by the present disclosure includes a frame 1, a vibration unit 2, a magnetic circuit unit 3, an electrical connector 4 and a holder 5. The electrical connector 4 includes an elastic arm 42 and a joint portion 41.

The frame 1 is fixedly provided at an end of the holder 5 close to the electrical connector 4.

The vibration unit 2 includes a diaphragm 21 and a voice coil 22. The diaphragm 21 is fixed to the holder 5. The voice coil 22 drives the diaphragm 21 to vibrate.

Figure 6:
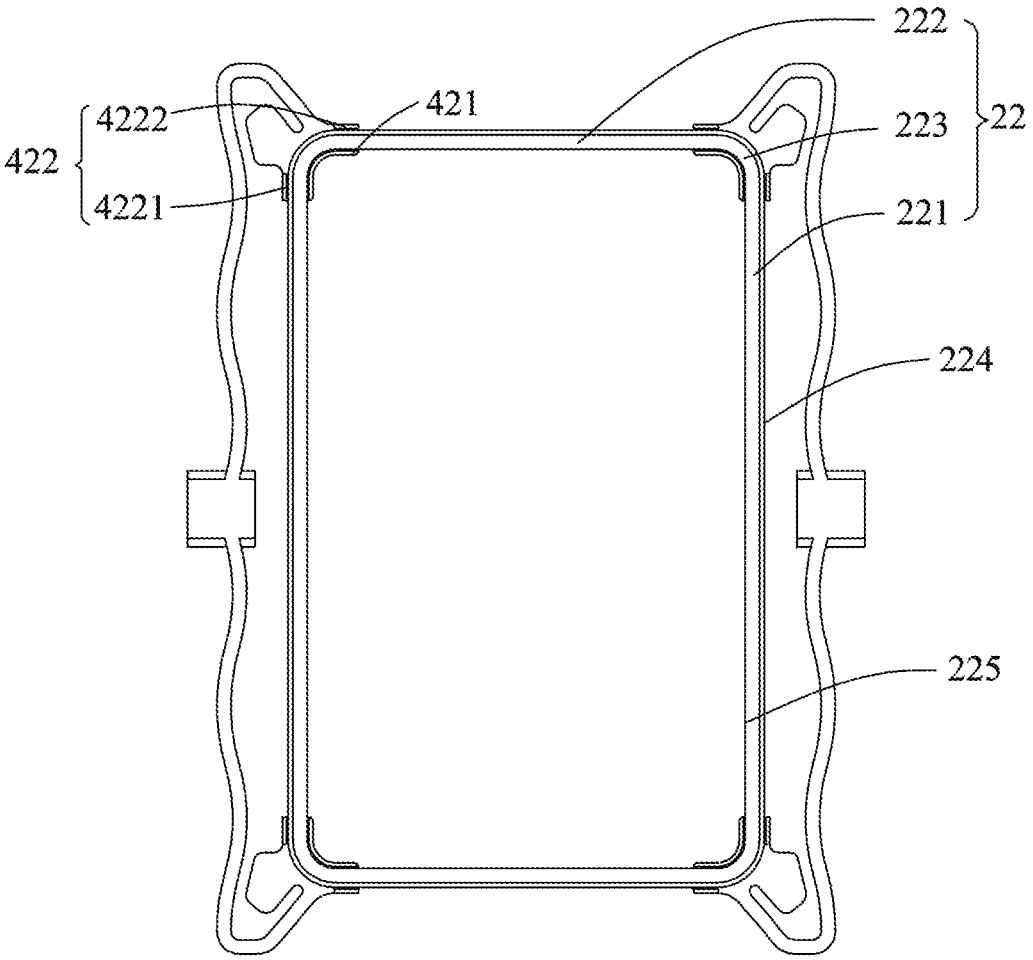
FIG. 6 is a diagram showing assembly of an electrical connector and a voice coil of a speaker according to an embodiment of the present disclosure.

Referring to FIG. 6, the voice coil 22 includes an outer side surface 224 close to the elastic arm 42 and an inner side surface 225 provided opposite to the outer side surface 224.

The voice coil 22 includes two opposite long axis sides 221 and two opposite short axis sides 222. The long axis sides 221 and the short axis sides 222 are connected, head to tail, to form a ring shape. Each long axis side 221 forms a corner 223 with the short axis side 222 adjacent to the long axis side.

Figure 2:
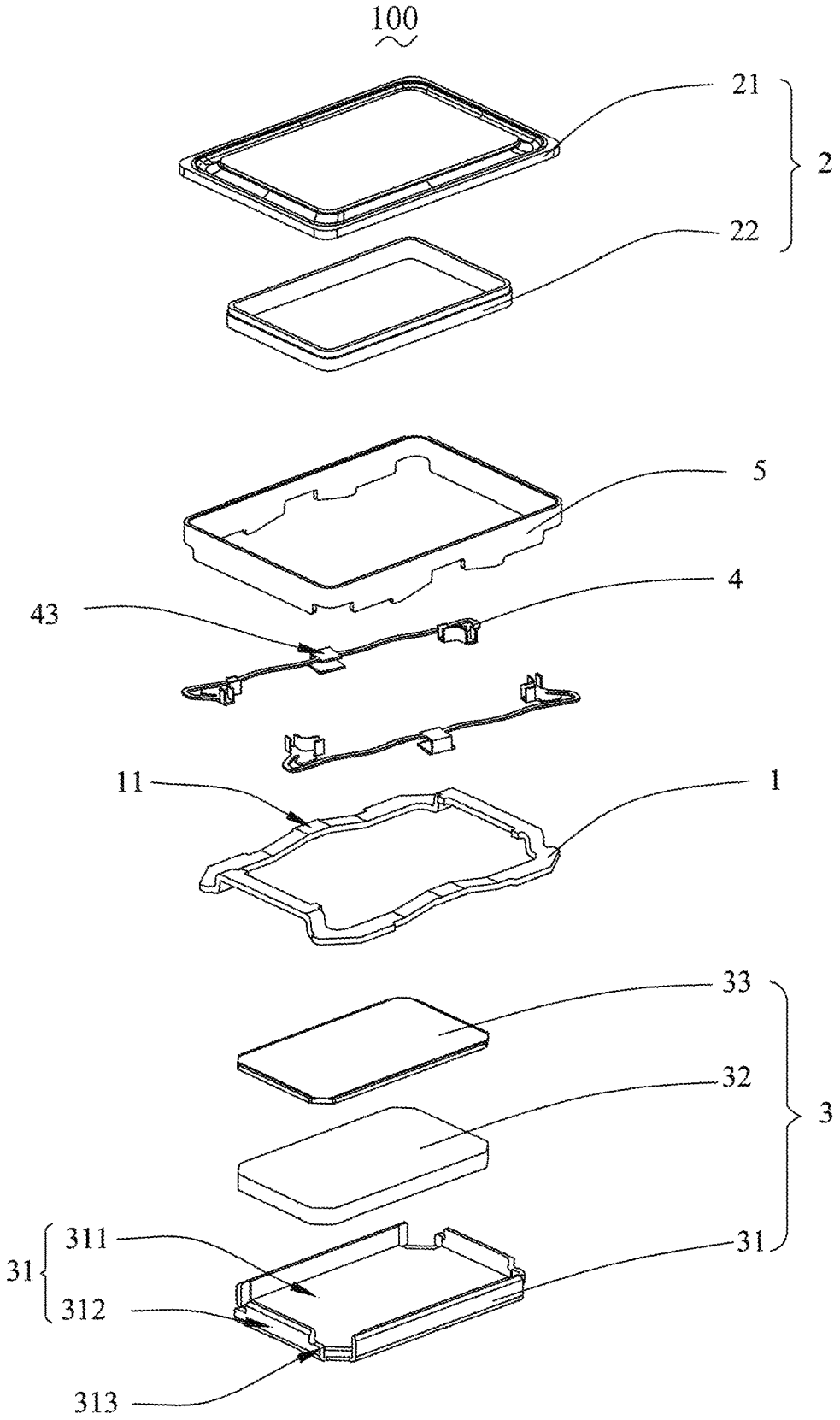
FIG. 2 is a perspective exploded structural view of a speaker according to an embodiment of the present disclosure.
Figure 3:
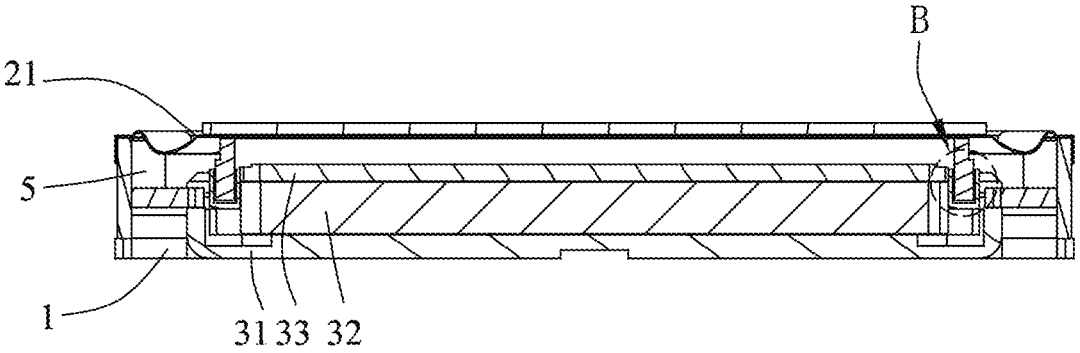
FIG. 3 is a cross-sectional view taken along line A-A of FIG. 1.
Figure 4:
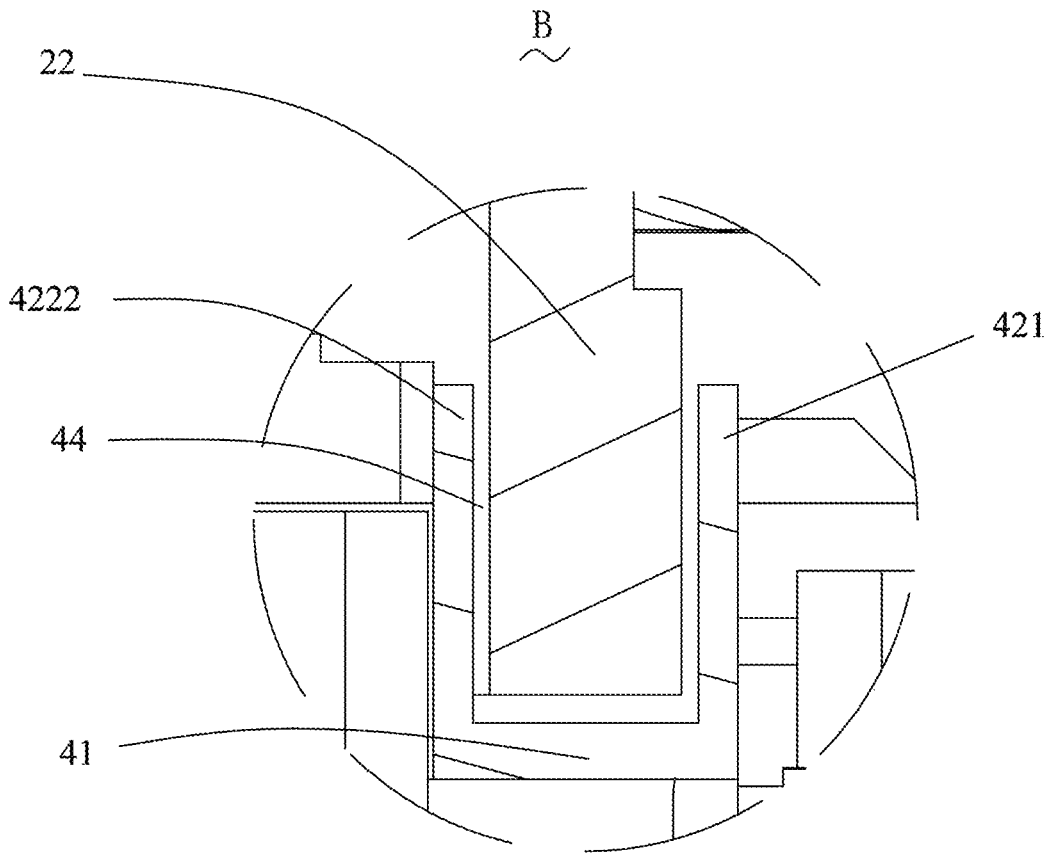
FIG. 4 is an enlarged view of the portion B shown in FIG. 3.

Referring to FIG. 2, the magnetic circuit unit 3 includes a yoke 31 fixed to the frame body 1, a magnet 32 fixed to the yoke 31, and a magnetic pole plate 33 fixedly connected to the magnet 32. The yoke 31 includes a bottom plate 311 fixing the magnet 32, and side plates 312 extending from the bottom plate 311 while being bent towards the diaphragm 21.

The bottom plate 311 is opposite to the diaphragm 21. The side plates 312 are formed between the voice coil 22 and the elastic arm 42. The side plates 312 correspondingly form notches 313 for avoiding the joint portions 41.

Figure 5:
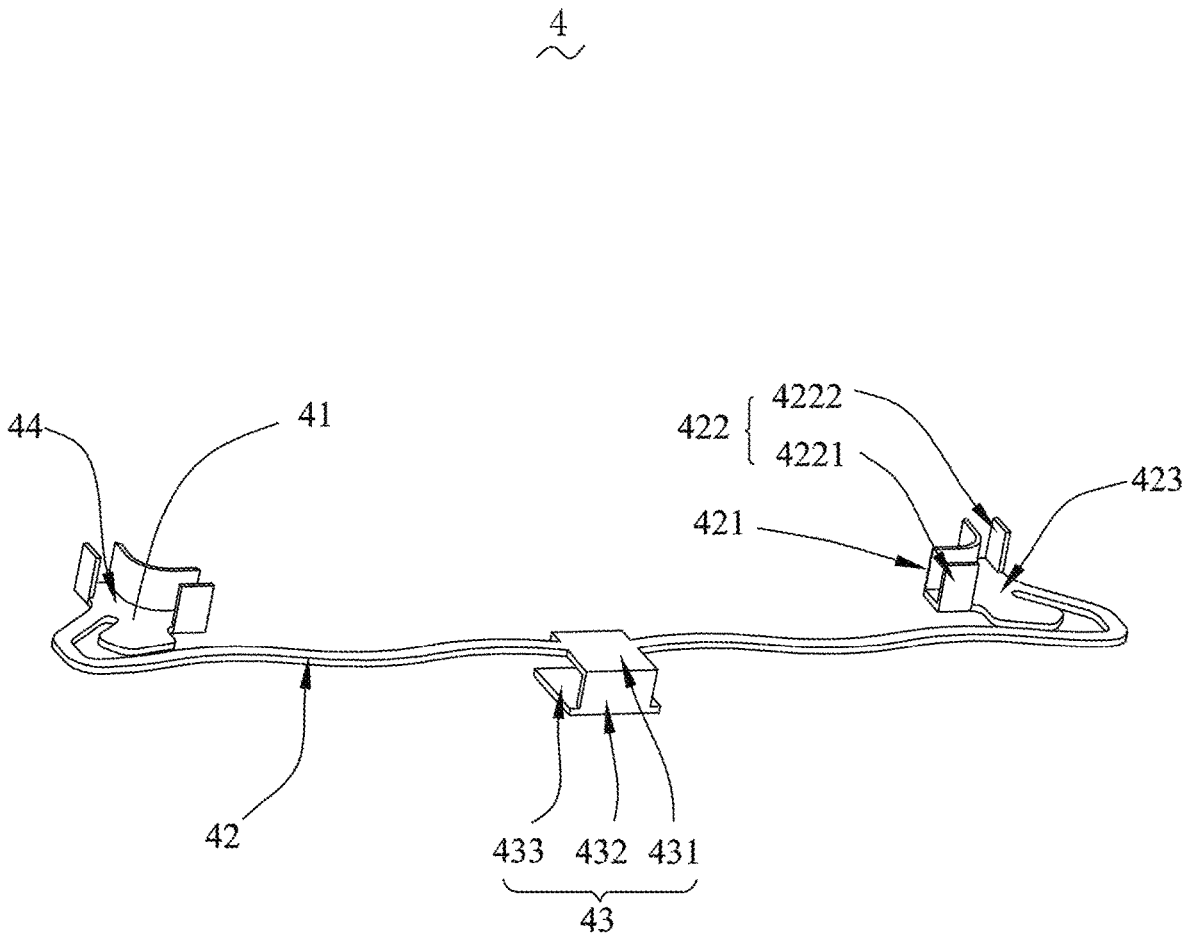
FIG. 5 is a structural diagram showing an electrical connector of a speaker according to an embodiment of the present disclosure.

Referring to FIGS. 2, 5 and 6, a pair of the electrical connectors 4 is elastically supported on an end of the voice coil 22 facing away from the diaphragm 21. Two electrical connectors 4 are in one-to-one correspondence to the long axis sides 221. The electrical connector 4 includes the elastic arm 42 spaced apart from the voice coil 22 and the joint portion 41 extending from two opposite ends of the elastic arm 42 while being bent towards the voice coil 22. The joint portion 41 is correspondingly formed at the corner portion 223.

Each joint portion 41 includes a body portion 423 supported at a side of the voice coil 22 facing away from the diaphragm 21, a first extension portion formed by extending from the body portion 423 and being opposite to the inner side surface 225, and a second extension portion 422 opposite to the outer side surface 224. The first extension portion 421 and the second extension portion 422 are spaced apart to form a receiving groove 44. The voice coil 22 is sandwiched and fixed in the receiving groove 44.

The second extension portion 422 includes a first portion 4221 bonded to the long-axis side 221, and a second portion 4222 bonded to the short-axis side 222.

The elastic arm 42 is provided with a pad 43 extending at least partially to the outside of the holder 5 for an electrical connection with the outside. The pad 43 includes an extension portion 431 extending from the elastic arm 42 in a direction facing away from the voice coil 22, a connection portion 432 being extending from a distal end of the extension portion 431 in a direction facing away from the diaphragm 21, and a conductive portion 433 bent and extending from an end of the connection portion 432 facing away from the extension portion 431. The conductive portion 433 faces the extension portion 431. The frame body 1 is sandwiched between the conductive portion 433 and the extension portion 431.

The joint portions 41 at the two ends of the elastic arm 42 of each electrical connector 4 are correspondingly provided at the corner portions 223 at two ends of the long-axis side 221, so that an integral structure of the voice coil 22 and the electrical connector 4 is a symmetrical structure. This can reduce the swing problem caused by the unbalanced force applied on the voice coil 22 due to unbalanced magnetic flux density at various locations of the voice coil 22.

Moreover, the first extension portion 421 is fixedly bonded to the inner side of the corner portion 223, and the second extension portion 442 is fixedly bonded to the outer side of the corner portion 223, thereby increasing a gluing area, so that the connection between the joint portion 41 and the voice coil 22 becomes stronger.

Compared with the related art, in the speaker provided by the present disclosure, the electrical connector is provided at the lower end of the voice coil. The first extension portion and the second extension portion provided on the joint portion of two ends of the electrical connector wraps the corner portion of the voice coil therein. The first extension portion and the second extension portion are then respectively bonded and fixed to the inner and outer sides of the corner portion by glue, thereby increasing the bonding area and also increasing the bonding strength between the first and second extension portions and the corner portion. In addition, with such a structure, the swing and disconnection problem of the voice coil occurring during the operation of the speaker can be significantly alleviated, thereby reducing the problems of touching the magnet and unbalanced amplitude caused by the swing of voice coil, while increasing the maximum amplitude.

The above are only preferred embodiments of the present disclosure. Here, it should be noted that those skilled in the art can make modifications without departing from the inventive concept of the present disclosure, but these shall fall into the protection scope of the present disclosure.

What is claimed is:

1. A speaker, comprising:

a vibration unit;

a magnetic circuit unit;

a holder configured to receive a vibration unit and the magnetic circuit unit in a receiving space, the vibration unit comprising a diaphragm and a voice coil driving the diaphragm to vibrate, and at least one electrical connector elastically supported at an end of the voice coil facing away from the diaphragm, wherein each of the at least one electrical connector comprises an elastic arm spaced from the voice coil and joint portions extending from two opposite sides of the elastic arm while being bent towards the voice coil, the voice coil comprises an outer side surface close to the elastic arm and an inner side surface opposite to the outer side surface, each of the joint portions comprises a body portion supported at a side of the voice coil facing away from the diaphragm, a first extension portion formed by extending from the body portion and being opposite to the inner side surface, and a second extension portion formed by extending from the body portion and being opposite to the outer side surface, the first extension portion and the second extension portion are spaced apart to form a receiving groove, and the voice coil is sandwiched and fixed in the receiving groove; and wherein the voice coil comprises two long axis sides provided opposite to each other and two short axis sides provided opposite to each other, wherein the long axis sides and the short axis sides are connected, head to tail, to form a ring shape, the two long-axis sides forming corner portions with respective ones of the two short-axis sides adjacent to the long-axis side, and the joint portions are correspondingly formed at the corner portions, respectively.

2. The speaker as described in claim 1, wherein the second extension portion comprises a first portion bonded to one of the two long-axis sides and a second portion bonded to one of the two short-axis sides.

3. The speaker as described in claim 2, wherein the at least one electrical connector comprises two electrical connectors, and the two electrical connectors are provided in one-to-one correspondence to the two long-axis sides.

4. The speaker as described in claim 1, further comprising a frame body fixedly provided at an end of the holder close to the electrical connector, the electrical connector further comprises a pad formed at the elastic arm, and the pad extends at least partially to out of the holder for an electrical connection with an external circuit.

5. The speaker as described in claim 4, the pad comprises an extension portion extending from the elastic arm in a direction facing away from the voice coil, a connection portion bent and extending from a distal end of the extension portion in a direction facing away from the diaphragm, and a conductive portion bent and extending from an end of the connection portion facing away from the extension portion, the conductive portion being opposite to the extension portion, and the frame body being sandwiched between the conductive portion and the extension portion.

6. The speaker as described in claim 5, further comprising a magnetic circuit unit provided in the receiving space, the magnetic circuit unit comprises a yoke fixed to the frame body, a magnet fixed to the yoke, and a magnetic pole plate fixedly connected to a side of the magnet facing away from the yoke.

7. The speaker as described in claim 6, wherein the yoke comprises a bottom plate for fixing the magnet and side plates extending from the bottom plate while being bent towards the diaphragm, the bottom plate is opposed to the diaphragm, and the side plates are formed between the voice coil and the elastic arm.

8. The speaker as described in claim 7, wherein the side plates form notches for avoiding respective ones of the joint portions.

* * * * *